US011841639B2

(12) United States Patent
Okuma

(10) Patent No.: US 11,841,639 B2
(45) Date of Patent: Dec. 12, 2023

(54) IMAGE FORMING APPARATUS HAVING AN ABNORMALITY DETECTION MODE

(71) Applicant: CANON KABUSHIKI KAISHA, Tokyo (JP)

(72) Inventor: Yasuhiko Okuma, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/752,578

(22) Filed: May 24, 2022

(65) Prior Publication Data

US 2022/0382184 A1 Dec. 1, 2022

(30) Foreign Application Priority Data

May 31, 2021 (JP) ..... 2021-091609

(51) Int. Cl.
*G03G 15/08* (2006.01)
*G03G 15/00* (2006.01)

(52) U.S. Cl.
CPC ..... *G03G 15/0862* (2013.01); *G03G 15/0879* (2013.01); *G03G 15/0891* (2013.01); *G03G 15/55* (2013.01); *G03G 15/556* (2013.01); *G03G 2215/0897* (2013.01)

(58) Field of Classification Search
CPC ..... G03G 15/0862; G03G 15/0891; G03G 15/556; G03G 15/0879; G03G 15/55; G03G 2215/0891; G03G 2215/0894; G03G 2215/0897
See application file for complete search history.

(56) References Cited

U.S. PATENT DOCUMENTS 5,532,791 A * 7/1996 Takahashi ..... G03G 15/0893 399/61
6,112,046 A * 8/2000 Suzuki ..... G03G 21/105 399/359
6,330,402 B1 * 12/2001 Sakurai ..... G03G 15/0858 399/27

(Continued)

FOREIGN PATENT DOCUMENTS

JP 2005-062648 A 3/2005
JP 2006-220960 A 8/2006

(Continued)

*Primary Examiner* — Arlene Heredia
*Assistant Examiner* — Laura Roth
(74) *Attorney, Agent, or Firm* — Canon U.S.A., Inc. I.P. Division

(57) ABSTRACT

An image forming apparatus includes a toner container, a first conveyance unit, and an apparatus main body. The apparatus main body includes a photosensitive drum, a development roller, a second conveyance unit, a toner conveyance passage, light sensor, an acquisition unit, and a control unit configured to execute an abnormality detection mode. In an abnormality detection mode, the acquisition unit acquires a first acquired value after the driving of the second conveyance unit with the driving of the first conveyance unit stopped. When the first acquired value satisfies a first condition, the acquisition unit further acquires a second acquired value after the driving of the second conveyance unit with the driving of the first conveyance unit stopped. The apparatus main body further includes a notification unit to make notification of the abnormality when the second acquired value satisfies a second condition.

10 Claims, 14 Drawing Sheets

(56) References Cited

U.S. PATENT DOCUMENTS

| | | | | |
|---|---|---|---|---|
| 2005/0041998 | A1* | 2/2005 | Fujii | G03G 15/0865 399/258 |
| 2017/0068205 | A1* | 3/2017 | Shinotsuka | G03G 15/0889 |
| 2020/0218190 | A1* | 7/2020 | Kai | G03G 15/0877 |

FOREIGN PATENT DOCUMENTS

| | | | |
|---|---|---|---|
| JP | 2013-057841 | A | 3/2013 |
| JP | 2017-122772 | A | 7/2017 |

* cited by examiner

IMAGE FORMING APPARATUS HAVING AN ABNORMALITY DETECTION MODE

BACKGROUND OF THE INVENTION

Field of the Invention

The present invention relates to an image forming apparatus using an electrophotographic system, such as a printer, a copying machine, and a facsimile.

Description of the Related Art

There is known an image forming apparatus that supplies toner in the toner container to the development device via the hopper, among image forming apparatuses with an electrophotographic system. Image forming apparatuses with that system use a sensor that detects the quantity of toner in the development device. In response to when the quantity of toner in the development device becomes less than or equal to a predetermined value, the image forming apparatus makes notification as an abnormality message. Detection of decrease in the quantity of toner in the development device can be caused by abnormality in the conveyance mechanism that conveys toner from the hopper to the development device.

Japanese Patent Application Laid-Open No. 2006-220960 discusses an image forming apparatus that uses a method of detecting an abnormality of conveyance in the hopper that supplies toner to the development device. In response to when an abnormality of the quantity of toner in the development device occurs, the apparatus supplies toner from the hopper to the development device for a predetermined time. If there is no abnormality of conveyance in the hopper, the operation of supplying toner to the development device causes toner in the hopper to eventually run out while to increase in the development device. According to Japanese Patent Application Laid-Open No. 2006-220960, in supplying toner to the development device for a predetermined time, the image forming apparatus determines that an abnormality of conveyance of toner occurs in the hopper if the sensor in the hopper continues detecting the presence of toner with no increase in the quantity of toner in the development device.

However, according to Japanese Patent Application Laid-Open No. 2006-220960, the image forming apparatus relies on two sensors to determine abnormality of conveyance in the hopper: one in the hopper and the other in the development device at a distant location from the hopper.

SUMMARY OF THE INVENTION

According to an aspect of the present invention, an image forming apparatus includes a toner container configured to accommodate toner, the toner container being provided with an outlet, the toner container including a first conveyance unit configured to discharge toner to an outside of the toner container through the outlet, and an apparatus main body on which the toner container is detachably mounted. The apparatus main body includes a photosensitive drum, a development roller configured to supply toner to the photosensitive drum, a second conveyance unit configured to convey toner toward the development roller, a toner conveyance passage in which the second conveyance unit is provided and which is provided with a receiving inlet to receive toner discharged from the outlet of the toner container, a sensor including a light emitting portion configured to emit light toward an inside of the toner conveyance passage, and a light receiving portion configured to receive light emitted from the light emitting portion and passing through the inside of the toner conveyance passage, the sensor being configured to output a signal based on a quantity of light received by the light receiving portion, an acquisition unit configured to acquire an acquired value based on an output value from the sensor, and a control unit configured to control driving of the first conveyance unit and the second conveyance unit independently and to execute an abnormality detection mode. In the abnormality detection mode, the acquisition unit is configured to acquire a first acquired value after execution of the driving of the second conveyance unit for a first predetermined time in a state where the driving of the first conveyance unit is stopped. In a case where the first acquired value satisfies a first condition, the acquisition unit is configured to further acquire a second acquired value after execution of the driving of the second conveyance unit for a second predetermined time in a state where the driving of the first conveyance unit is stopped. The apparatus main body further includes a notification unit configured to make notification of an abnormality in the toner conveyance passage. In a case where the second acquired value satisfies a second condition, the notification unit is configured to make notification of the abnormality.

Further features of the present invention will become apparent from the following description of exemplary embodiments with reference to the attached drawings.

DESCRIPTION OF THE EMBODIMENTS

Image Forming Apparatus

Figure 1:
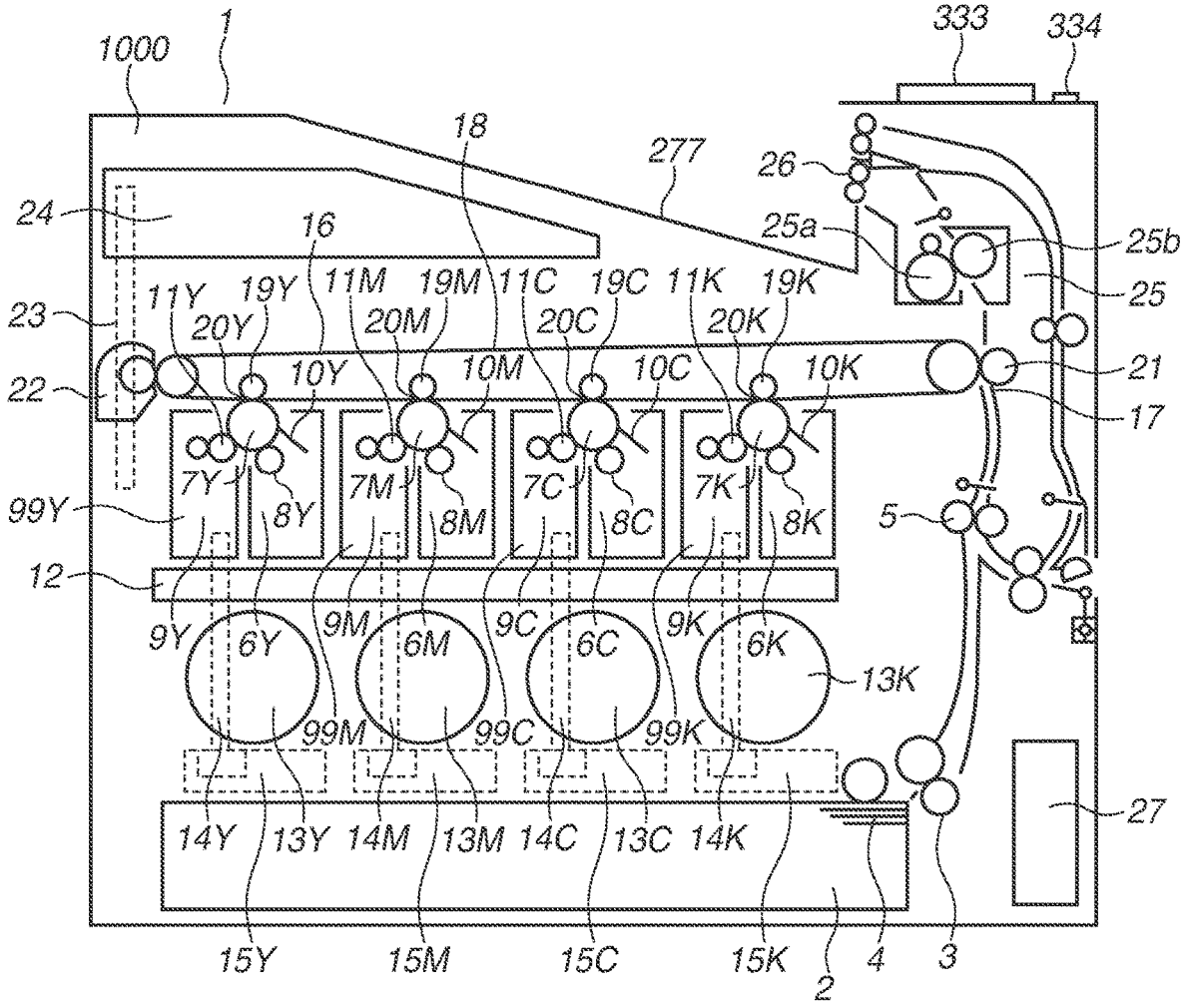
FIG. 1 is a main sectional view illustrating an image forming apparatus according to a first exemplary embodiment.

An image forming apparatus 1 according to a first exemplary embodiment will be described. FIG. 1 is a schematic sectional view of the image forming apparatus 1 according to the present exemplary embodiment.

The image forming apparatus 1 includes process cartridges 6Y, 6M, 6C, and 6Bk (hereinafter referred to as a process cartridge 6) that are detachably mounted on an apparatus main body 1000. The process cartridge 6 includes a photosensitive drum 7, a cleaning blade 10, a charging device 8, and a development device 9. The development device 9 includes a development roller 11 for supplying toner to the photosensitive drum 7, and a toner accommodation unit 99 (first toner accommodation unit) that accommodates toner to be borne by the development roller 11.

The image forming apparatus 1 causes a laser scanner unit 12 to emit laser onto the photosensitive drum 7 based on image information acquired by a control unit 27. The image forming apparatus 1 develops the latent image thereby formed on the photosensitive drum 7 as a toner image with toner supplied from the development roller 11.

The developed toner image is transferred to an intermediate transfer belt 18 by a primary transfer portion 20, each color being sequentially transferred to the toner image, whereby the toner image composed of four colors is formed on the surface of the intermediate transfer belt 18. That toner image is conveyed to a secondary transfer portion 17.

Toner containers 13 (13Y, 13M, 13C, and 13Bk) are arranged under the process cartridge 6. The image forming apparatus 1 includes a toner conveyance device 14 for supplying toner from the toner container 13 to the toner accommodation unit 99 of the development device 9. The toner conveyance device 14 is driven by a toner conveyance driving device 15 arranged under the toner conveyance device 14.

A recording material 4 is accommodated in a cassette 2 in the lower portion of the image forming apparatus 1. Rotation of a pickup roller 3 separates and feeds the recording material 4 one sheet by one sheet. Thereafter, the recording material 4 is conveyed by a registration roller 5 downstream.

Subsequently, an intermediate transfer unit 16 is arranged in the upper portion of the image forming apparatus 1. The intermediate transfer unit 16 is arranged substantially horizontally with the primary transfer portion 20 at the lower. An intermediate transfer belt 18 facing each photosensitive drum 7 is a rotatable endless belt, and is stretched by a plurality of stretching rollers. A primary transfer roller 19 serving as a primary transfer member is arranged on the internal surface of the intermediate transfer belt 18. The primary transfer roller 19, together with each photosensitive drum 7, forms the primary transfer portion 20 with the intermediate transfer belt 18 interposed between the primary transfer roller 19 and each photosensitive drum 7. At each primary transfer portion 20, a voltage is applied to the primary transfer roller 19, and a toner image is transferred from each photosensitive drum 7 to the intermediate transfer belt 18. According to the present exemplary embodiment, the intermediate transfer unit 16 as a unit including the intermediate transfer belt 18, the plurality of stretching rollers that stretches the intermediate transfer belt 18, and each primary transfer roller 19 is detachably mounted on the apparatus main body.

A secondary transfer roller 21 serving as a secondary transfer member is in contact with the intermediate transfer belt 18, and forms, together with a roller on the opposite site, the secondary transfer portion 17 with the intermediate transfer belt 18 interposed between the second transfer roller 21 and the roller on the opposite side. At the secondary transfer portion 17, the toner image transferred on the intermediate transfer belt 18 is secondarily transferred to the recording material 4. Toner that has not been transferred in the secondary transfer and that remains on the intermediate transfer belt 18 is removed by a cleaning unit 22. Toner removed by the cleaning unit 22 is conveyed to a toner collecting container 24 by way of a collected toner conveyance unit 23.

The recording material 4, on which the unfixed toner image is transferred, is further conveyed downstream, and then pressed and heated by a heating unit 25*a* and pressure roller 25*b* of a fixing device 25, respectively, which causes toner to melt, whereby the toner image is fixed to the recording material 4. Thereafter, the recording material 4 is discharged to a discharge tray 277 by a discharge roller pair 26. Image formation on the recording material 4 is performed through these series of operations. A mode of performing these series of operations is hereinafter referred to as an "image formation mode".

The control unit 27 of the image forming apparatus 1 performs overall control of the image forming apparatus 1, and includes one or more central processing units (CPUs), a read-only memory (ROM) that stores programs run by the CPU(s) and data, and a random-access memory (RAM) that is used as a work area of the CPU(s).

Toner Conveyance Unit 900

Figure 2:
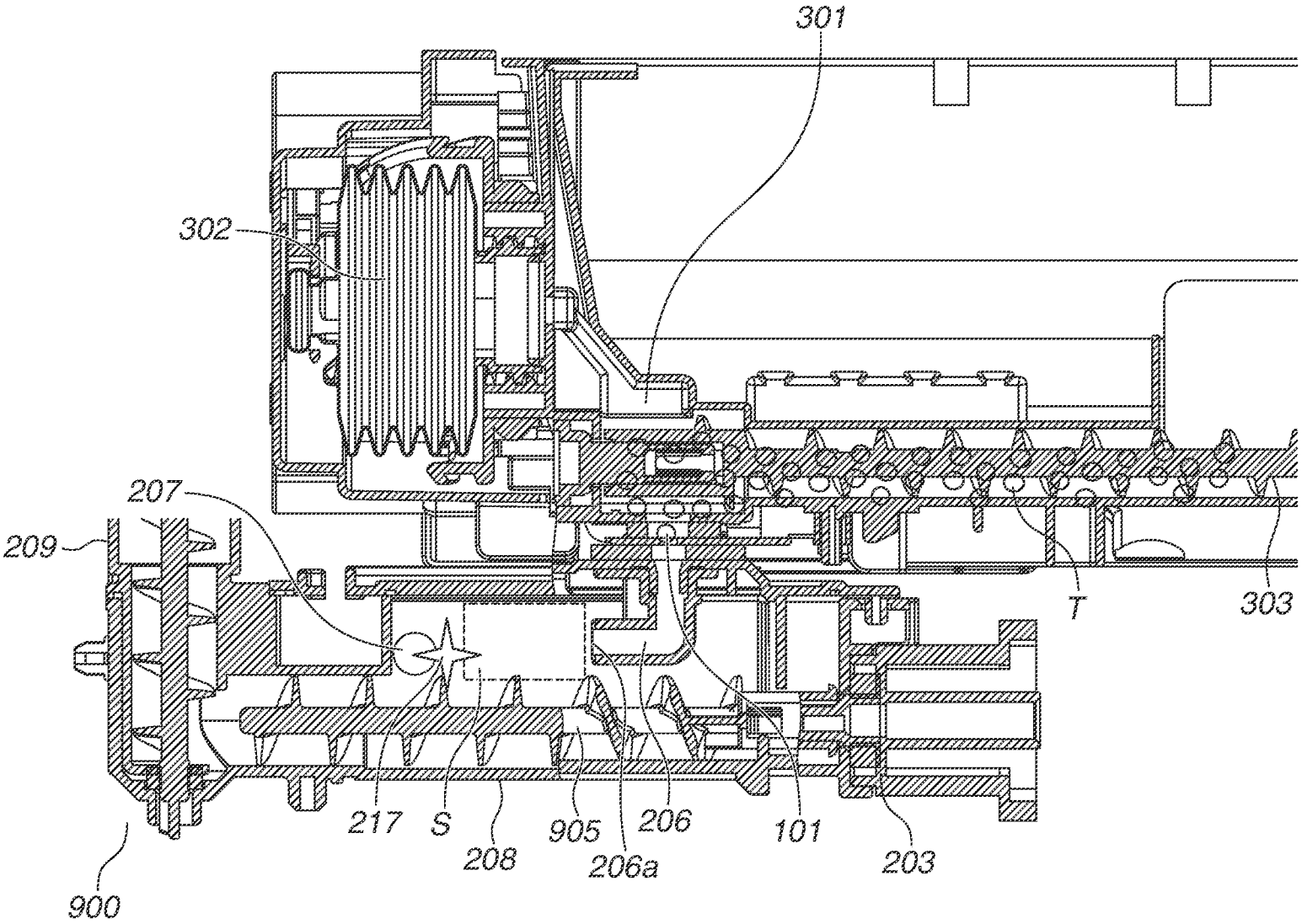
FIG. 2 is a sectional view illustrating a toner conveyance unit and a toner container according to the first exemplary embodiment.
Figure 3:
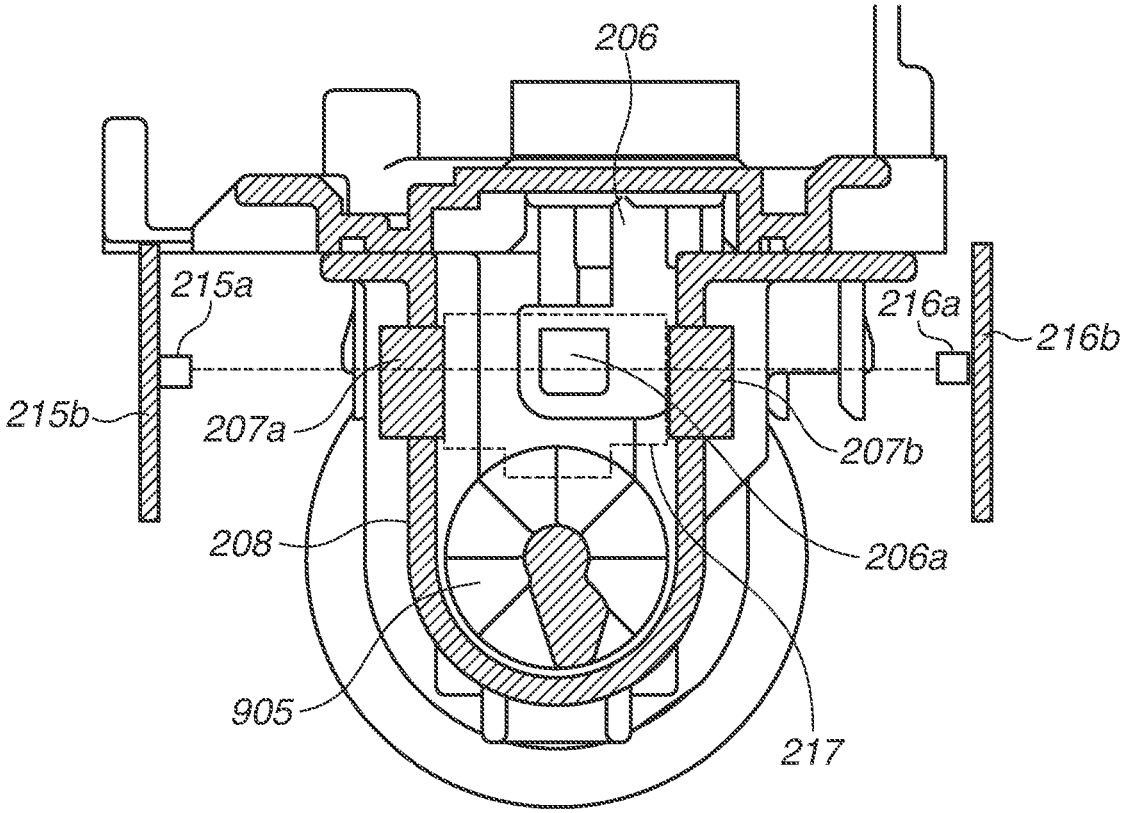
FIG. 3 is a main sectional view illustrating the toner conveyance unit according to the first exemplary embodiment.

Details of the toner conveyance device 14 will be now described with reference to FIGS. 2 and 3. The toner conveyance device 14 includes a toner conveyance unit 900 that conveys toner received from the toner container 13 to the development device 9. In the present exemplary embodiment, a detailed description of the development device 9 will be omitted. FIG. 2 is a sectional view illustrating the toner conveyance device 14, a pump 302, and the toner conveyance driving device 15 as seen from a lateral side. FIG. 3 is a sectional view illustrating the toner conveyance driving device 15.

The toner conveyance unit 900 includes a cylindrical first toner conveyance path 208 (passage, second toner accommodation unit) and an upstream conveyance screw 905 (second conveyance unit). The first toner conveyance path 208 is provided with a receiving inlet 101 in the upper surface thereof and extends in the horizontal direction. The upstream conveyance screw 905 is disposed inside the first toner conveyance path 208 and conveys toner. A toner receiving path 206 that extends downward from the receiving inlet 101 and that extends downstream in the toner conveyance direction of the upstream conveyance screw 905 is provided inside the first toner conveyance path 208.

The upstream conveyance screw 905 includes a shaft portion and a helical blade portion arranged on the outer periphery of the shaft portion. Rotation of the shaft portion and the blade portion in an integrated manner enables conveyance of toner.

The toner conveyance unit 900 includes a cylindrical second toner conveyance path 209 (a cylindrical second toner conveyance passage) that extends upward, and a downstream conveyance screw 904 that is provided inside the second toner conveyance path 209 and that conveys toner upward. The upstream end portion of the second toner conveyance path 209 is connected to the downstream end portion of the first toner conveyance path 208. The upstream conveyance screw 905 and the downstream conveyance screw 904 are driven by the toner conveyance driving device 15. The toner conveyance driving device 15 includes a conveyance motor 405 (second motor) and a driving gear 205 that is driven by the conveyance motor 405 and that transmits driving force to the upstream conveyance screw 905.

Sensor

The toner conveyance unit 900 includes a light transmitting portion 207 and a sensor 1516. The light transmitting portion 207 includes a light transmitting member 207*a* (first light transmitting portion) and a light transmitting member 207*b* (second light transmitting portion) that are arranged to face each other. The sensor 1516 includes a light emitting portion 215 and a light receiving portion 216. The light emitting portion 215 includes a light emitting device 215*a* and a circuit board 215*b* provided with the light emitting device 215*a*. The light receiving portion 216 includes a light receiving device 216*a* and a circuit board 216*b* provided with the light receiving device 216*a*.

The sensor 1516 outputs an output value based on the quantity of light received by the light receiving portion 216. An output value in the present exemplary embodiment is a voltage. The sensor 1516 in the present exemplary embodiment outputs a lower voltage as the quantity of light received by the light receiving portion 216 becomes greater, and outputs a higher voltage as the quantity of light received by the light receiving portion 216 becomes smaller.

Toner is supplied from the toner container 13 to the first toner conveyance path 208 via the receiving inlet 101 and the toner receiving path 206. Toner is conveyed by the upstream conveyance screw 905 through the first toner conveyance path 208 toward the second toner conveyance path 209.

A driving control unit 401 of the control unit 27 controls driving of the conveyance motor 405. The downstream conveyance screw 904 is connected to the most downstream portion of the upstream conveyance screw 905, and rotates in conjunction with the upstream conveyance screw 905. The toner conveyed by the upstream conveyance screw 905 is transferred to the downstream conveyance screw 904, and is conveyed by the downstream conveyance screw 904 toward the development device 9. The driving of the conveyance motor 405 by the driving control unit 401 causes rotational driving of the downstream conveyance screw 904 in conjunction with the upstream conveyance screw 905, whereby toner is conveyed upward. The toner conveyed upward is supplied to the development device 9 in FIG. 1.

The control unit 27 performs control to supply toner from the toner container 13 to the first toner accommodation unit 99 of the development device 9 via the toner conveyance unit 900, based on the quantity of remaining toner of the first toner accommodation unit 99 of the development device 9.

The toner that has passed through the toner receiving path 206 of the first toner conveyance path 208 is discharged from the leading end port 206*a* at the leading end of the toner receiving path 206 toward a region S above the upstream conveyance screw 905.

The light transmitting members 207*a* and 207*b* are arranged to fill a hole provided in the wall of the first toner conveyance path 208 in the vicinity of the connection portion between the upstream conveyance screw 905 and the downstream conveyance screw 904.

The arrangement of the light emitting portion 215 and the light receiving portion 216 will be now described. As illustrated in FIG. 3, light emitted from the light emitting portion 215 (light emitting device 215*a*) enters the inside of the first toner conveyance path 208 through the light transmitting member 207*a*. The light, which has been emitted from the light emitting portion 215 and passed through the inside of the first toner conveyance path 208, goes outside the first toner conveyance path 208 through the light transmitting member 207*b*, and is received by the light receiving portion 216 (light receiving element 216*a*). Toner in the region in the optical path inside the first toner conveyance path 208 blocks light, which reduces the quantity of light received by the light receiving portion 216, increasing the voltage value output from the sensor 1516. With no or little toner in the region, the quantity of light received by the light receiving portion 216 becomes larger, reducing the voltage value output from the sensor 1516. That is, the correlation between the voltage values output from the sensor 1516 and the quantity of toner in the first toner conveyance path 208 allows detection of the state of the first toner conveyance path 208 (toner conveyance unit 900) with the sensor 1516.

Cleaning Member

Figure 13A:
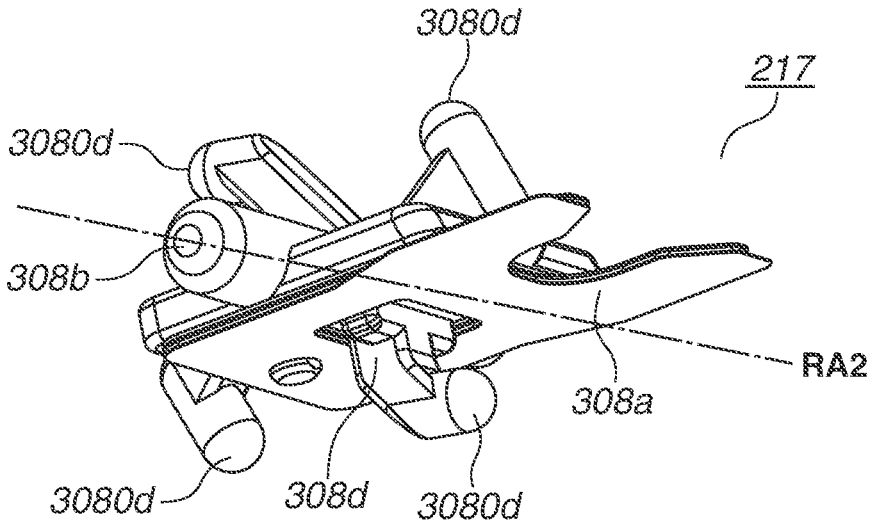
FIGS. 13A and 13B are perspective views illustrating a cleaning member according to the first and second exemplary embodiments.
Figure 13B:
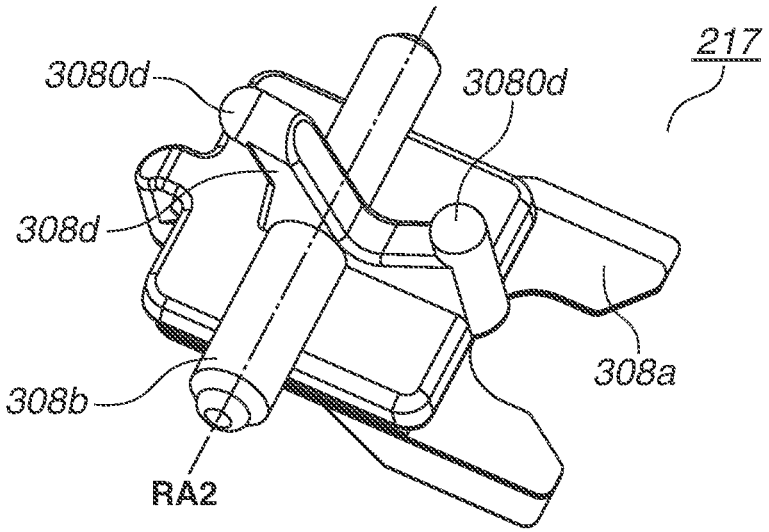

A cleaning member 217 is disposed in the vicinity of the light transmitting members 207*a* and 207*b*. FIGS. 13A and 13B are perspective views each illustrating the cleaning member 217. The cleaning member 217 includes a rotary shaft 308*b* (shaft portion) that rotates about a rotational axis RA2, and a sheet 308*a* that rotates together with the rotary shaft 308*b*.

The rotary shaft 308*b* is provided with a plurality of arm portions 308*d* (driving force receiving portions) that is in contact with the blade portion of the upstream conveyance screw 905 and that is used for receiving the driving force. With rotation of the blade portion of the upstream conveyance screw 905, a leading end portion 3080*d* of each arm portion 308*d* of the cleaning member 217 is pressed by the blade portion, whereby the cleaning member 217 is rotated. The rotational axis RA2 extends in the direction orthogonal to the rotational axis of the upstream conveyance screw 905.

The rotation of the cleaning member 217 causes the sheet 308*a* to rub the surfaces of the light transmitting members 207*a* and 207*a*. That action removes toner on the light transmitting members 207*a* and 207*b*. Toner on the light transmitting members 207*a* and 207*b* blocks light even if there is little toner in the region in the optical path, causing higher voltage values output from the sensor 1516. That can cause a detection by the sensor 1516 as an error that toner is excessively accumulated in the first toner conveyance path 208. To prevent that error, the light transmitting members 207*a* and 207*b* are cleaned by rotation of the cleaning member 217 on a regular basis.

Toner Conveyance Driving Device

Figure 5A:
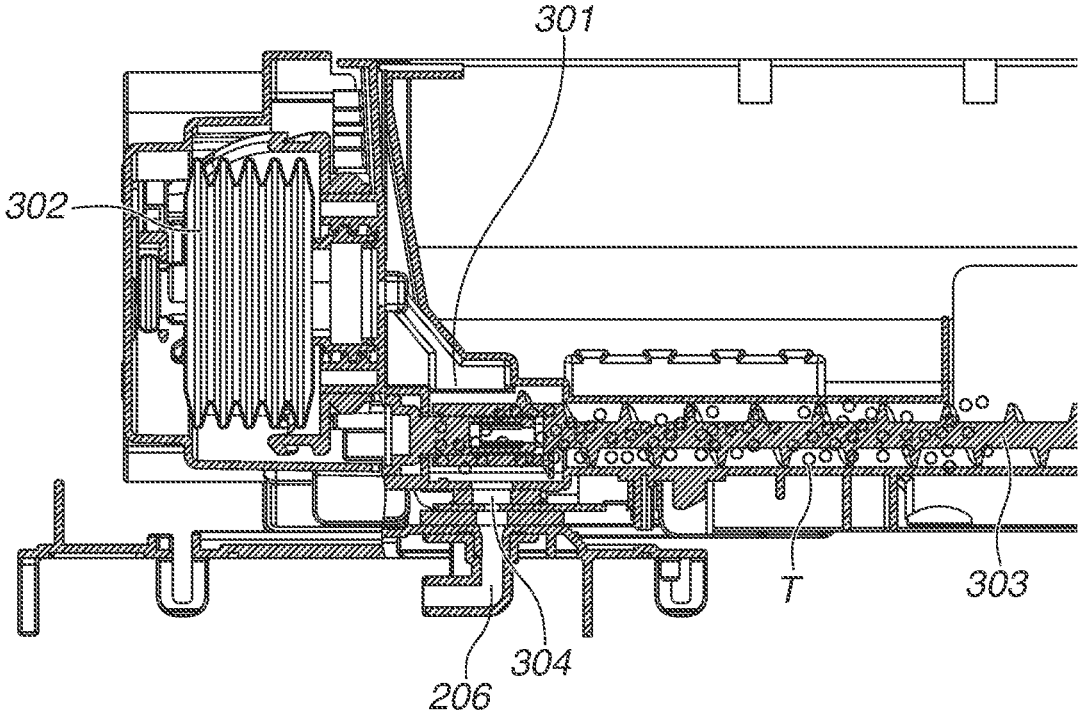
FIGS. 5A and 5B are sectional views of the toner container each illustrating motion of a pump according to the first exemplary embodiment.
Figure 5B:
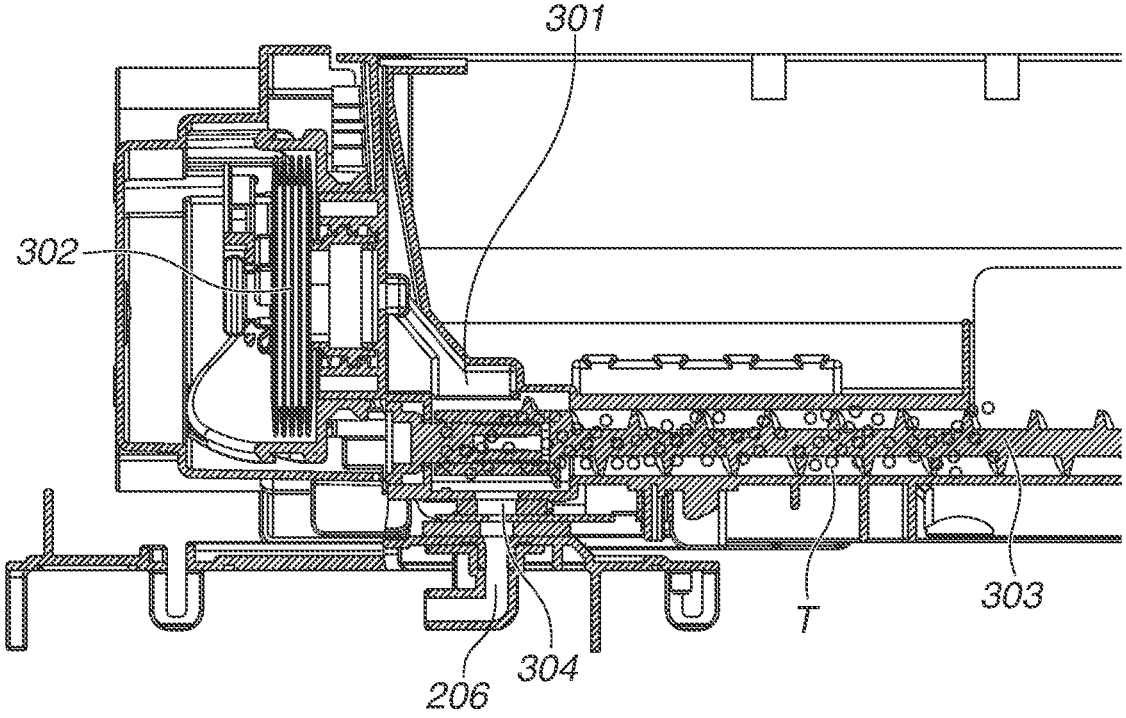

Subsequently, the toner conveyance driving device 15 will be now described in detail with reference to FIGS. 5A and 5B. FIGS. 5A and 5B are sectional views each illustrating the pump 302 and the toner container 13 as seen from the lateral side.

As illustrated in FIGS. 5A and 5B, the pump 302 is disposed downstream in the mounting direction of the toner container 13. Rotational driving of a supply motor 404 (first motor) performed by the control unit 27 causes the pump 302 to perform expanding and contracting motion in conjunction with a link mechanism (not illustrated). As illustrated in FIGS. 5A and 5B, rotation of the supply motor 404 causes the pump 302 to repeat expanding and contracting motion, which brings about an expanded state (FIG. 5A) and a contracted state (FIG. 5B), respectively. When the pump 302 is compressed as illustrated in FIG. 5B, the inner pressure of a toner accommodation chamber 301 increases, and toner conveyed to the inside of the toner accommodation chamber 301 by a toner supply screw 303 is discharged from an outlet 304 to the outside of the toner container 13. The toner discharged from the outlet 304 is supplied to the first toner conveyance path 208 via the receiving inlet 101. The control unit 27 controls the number of rotations (rotation speed) of the supply motor 404 per unit time, and thereby controls the quantity of toner supply per unit time from the toner container 13 to the first toner conveyance path 208. This is because the toner supply screw 303 is also driven by the supply motor 404. As the number of rotations of the toner supply screw 303 becomes smaller, the quantity of toner conveyed to the inside of the toner accommodation chamber 301 decreases and the cycle of expansion and contraction of the pump 302 extends. The number of rotations of the supply motor 404 is set to a default value with a new image forming apparatus 1. The control unit 27 may control the quantity of toner supply by changing supply time without changing the number of rotations per unit time.

Control Unit 27

Figure 4:
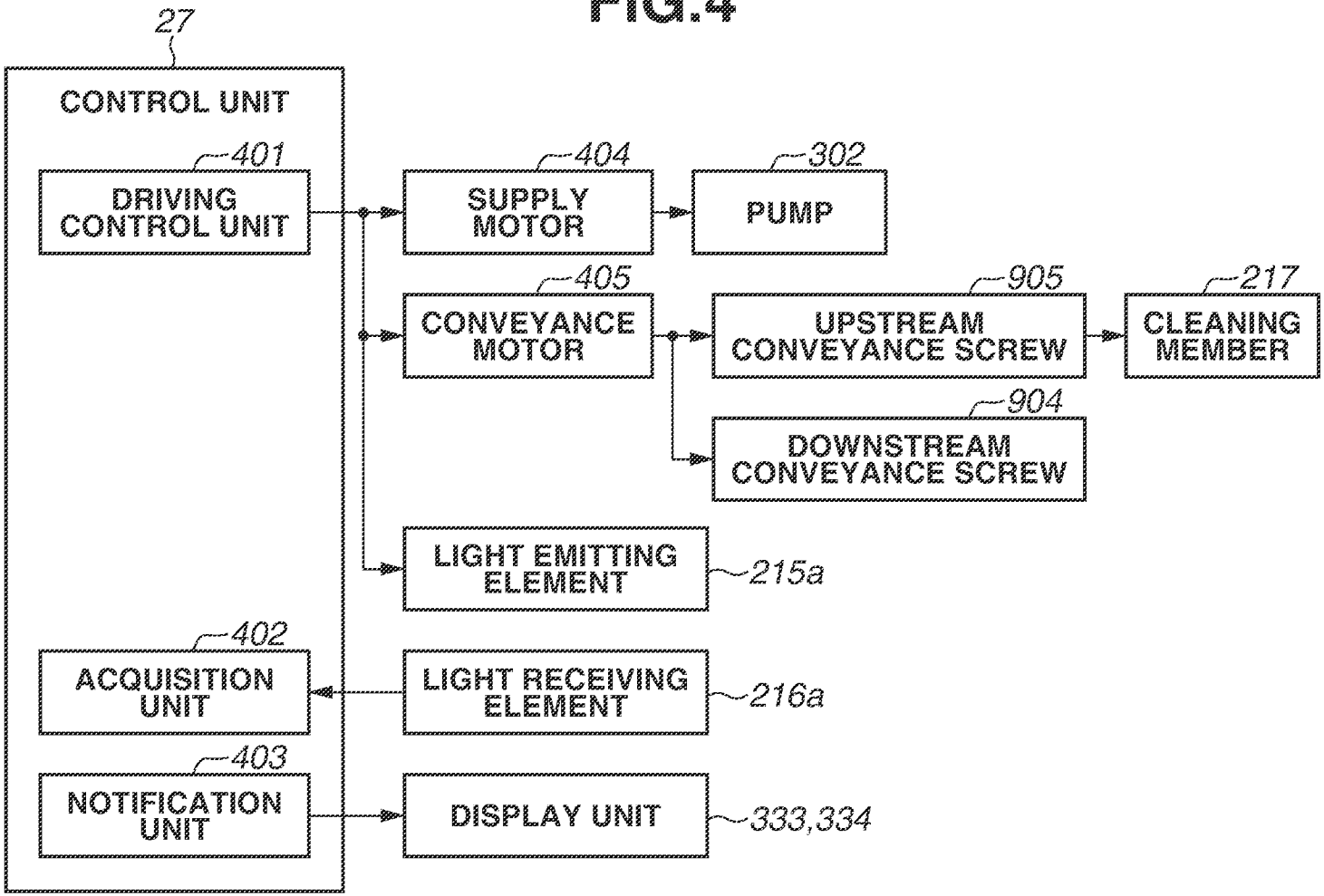
FIG. 4 is a control block diagram according to the first exemplary embodiment.

The control unit 27 will be described with reference to FIG. 4. FIG. 4 is a control block diagram. The control unit 27 includes the driving control unit 401, an acquisition unit 402, and a notification unit 403.

The driving control unit 401 drives the supply motor 404 at timings when toner supply becomes necessary and operates the pump 302. That operation causes toner to be supplied from the toner container 13 to the first toner conveyance path 208. Furthermore, the driving control unit 401 drives the conveyance motor 405 to cause the upstream conveyance screw 905, the cleaning member 217, and the downstream conveyance screw 904 to operate, thereby conveying toner to the development device 9. The driving control unit 401 causes the light emitting device 215*a* of the light emitting portion 215 to emit light at timings of detection of a state of the first toner conveyance path 208. A voltage, which is an output signal from the light receiving portion 216, is acquired as an acquired value by the acquisition unit 402. The notification unit 403 notifies a user of abnormality of the toner conveyance unit 900 through display of an operation panel 333 of the apparatus main body 1000 illustrated in FIG. 1 or lighting or blinking of a light emitting diode (LED) lamp 334.

In the above-mentioned image formation mode, the control unit 27 can perform first control and second control to control the supply motor 404 (pump 302) so that the quantity of toner supply per unit time from the toner container 13 to the first toner conveyance path 208 becomes a first quantity of supply and a second quantity of supply, respectively. The second quantity of supply is smaller than the first quantity of supply.

Abnormality Detection Mode

Subsequently, an abnormality detection mode for detecting an abnormality of the toner conveyance unit 900 in the present exemplary embodiment will be described with reference to FIGS. 6A to 6C, FIGS. 7A and 7B, and FIGS. 8A to 8C.

The condition that toner supplied from the toner container 13 with no toner clogging or no excessive toner accumulation in the toner conveyance unit 900 is conveyed to the development device 9 is hereinafter referred to as "normal". The condition with toner clogging in the toner conveyance unit 900 is referred to as "abnormal". The condition that the quantity of toner supplied from the toner container 13 to the toner conveyance unit 900 is greater than the quantity of toner supplied from the toner conveyance unit 900 to the development device 9 and that toner is excessively accumulated in the toner conveyance unit 900 is referred to as "excessive supply". Possible causes for excessive supply includes the installation environment of the image forming apparatus 1 and tolerances of parts regarding toner conveyance.

Figure 6A:
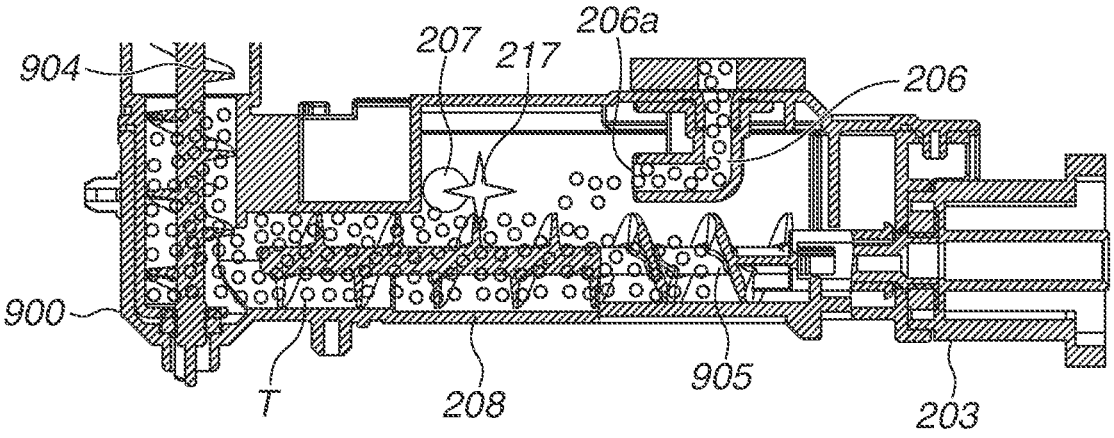
FIGS. 6A to 6C are sectional views each illustrating the toner conveyance unit according to the first exemplary embodiment.
Figure 6B:
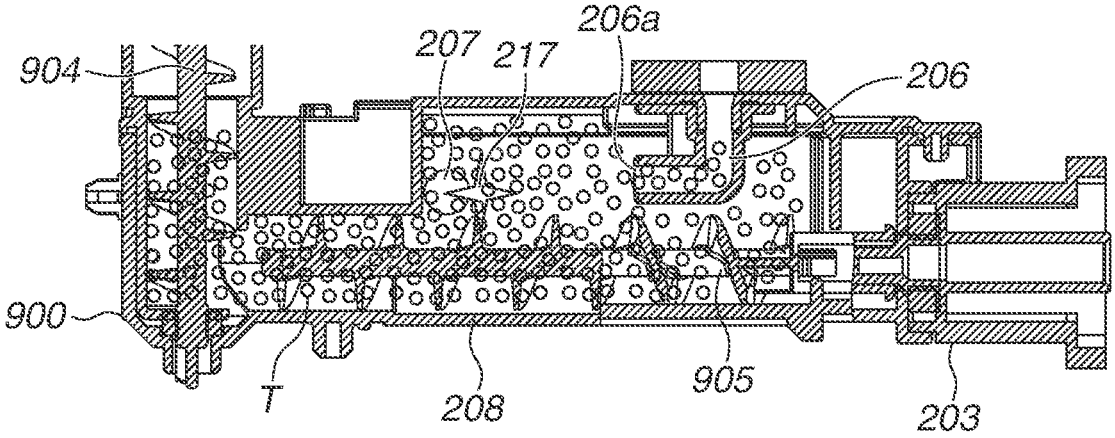
Figure 6C:
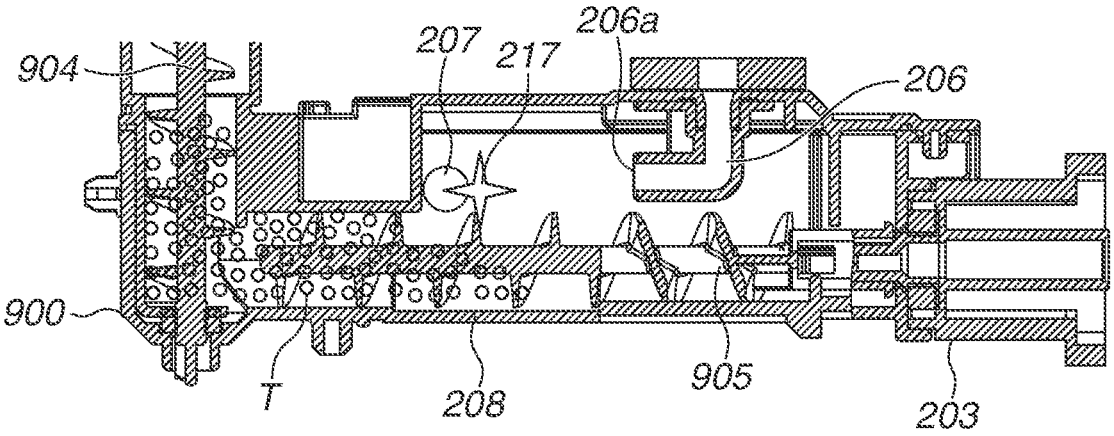

FIGS. 6A to 6C are sectional views each illustrating the toner conveyance unit 900. FIG. 6A illustrates the toner conveyance unit 900 in the normal condition. FIG. 6B illustrates a state where the optical path of the sensor 1516 is blocked due to an abnormality or excessive supply. FIG. 6C illustrates a state where excessive supply is eliminated by driving of the upstream conveyance screw 905 with toner supply from the toner container 13 stopped, and conveyance of toner downstream.

Figure 8A:
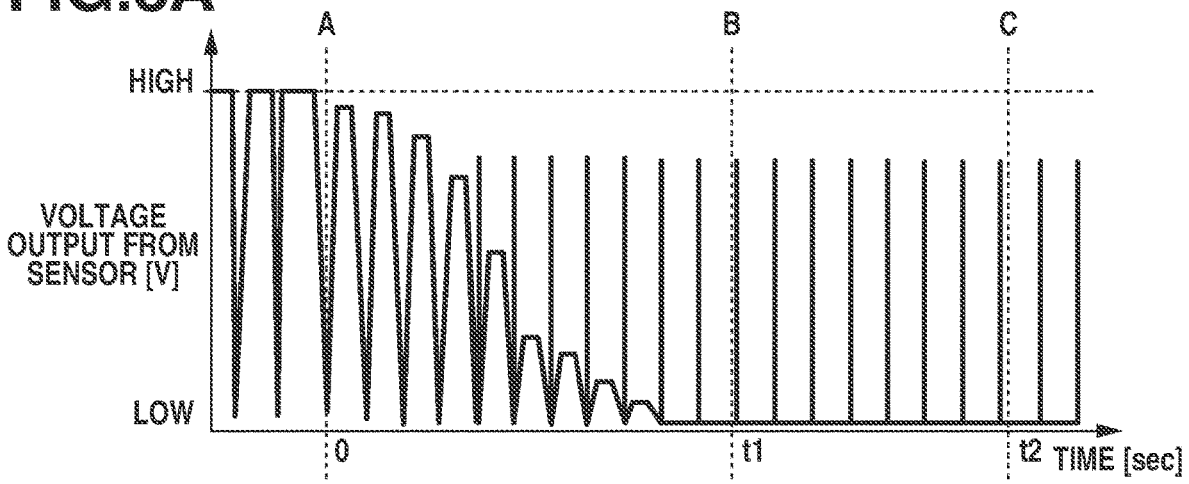
FIGS. 8A to 8C are graphs each illustrating a voltage waveform of a sensor according to the first exemplary embodiment.
Figure 8B:
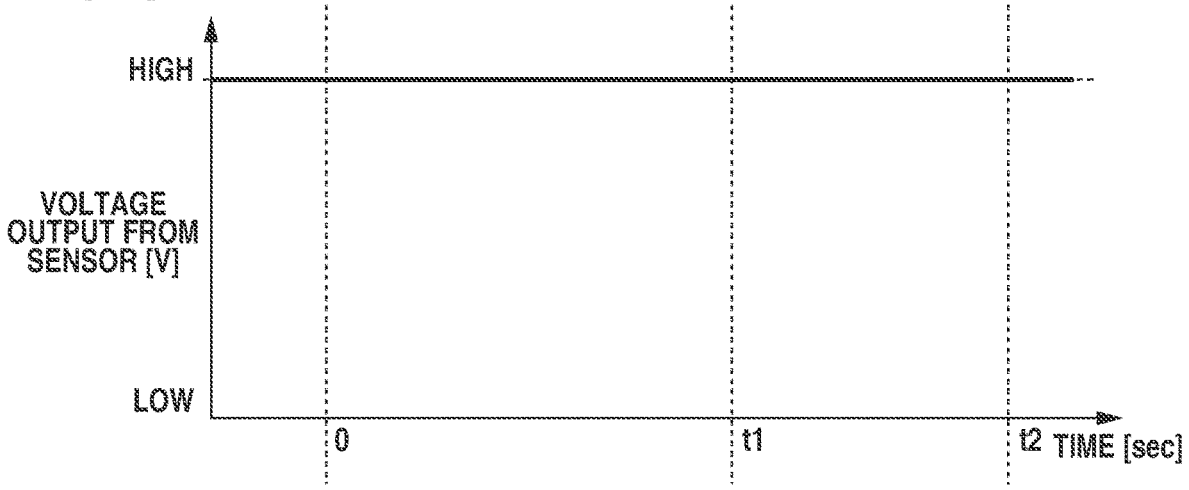

FIG. 8A is a schematic view illustrating a voltage waveform (temporal change in voltage value) output from the sensor 1516 under the normal condition. FIG. 8B is a schematic view illustrating a voltage waveform output from the sensor 1516 under the abnormal condition.

Figure 8C:
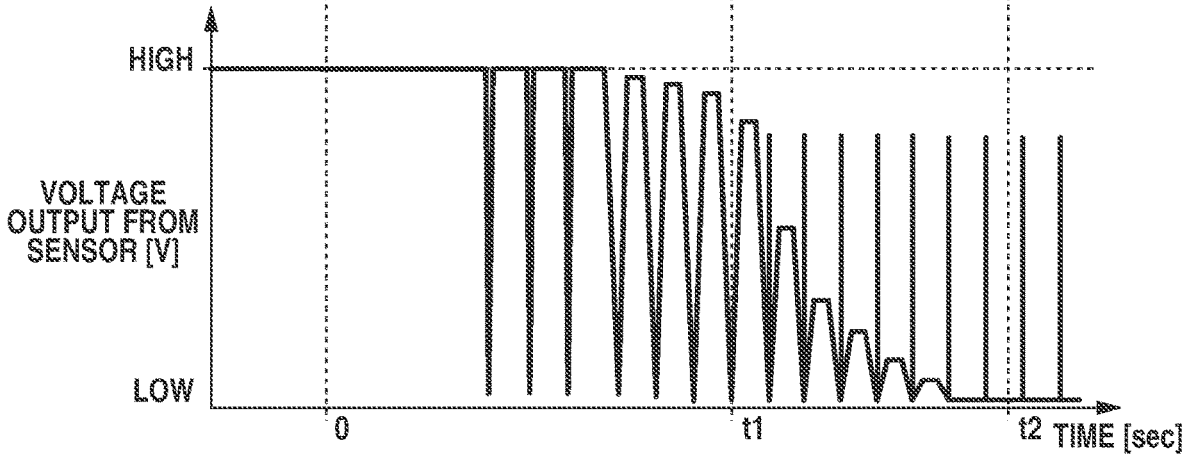

FIG. 8C is a schematic view illustrating a voltage waveform output from the sensor 1516 under the excessive supply condition. The ordinate axis in each of FIGS. 8A to 8C represents voltage values (V) output from the sensor 1516, and the voltage value fluctuates between Low and High. The abscissa axis represents time (sec). Both the supply motor 404 and the conveyance motor 405 are driven until time A on the abscissa axis. The supply motor 404 is stopped and the conveyance motor 405 is driven at the time A or later.

The voltage waveform in FIG. 8A will be now described. The voltage value instantly falls toward Low on a cyclic basis at some times until the time A on the abscissa axis in FIG. 8A, but is basically High. These falls of the voltage value on a cyclic basis occur due to space generated in toner by rotation of the cleaning member 217, the space of which gets light from the light emitting portion 215 through, and the light is temporarily received. At the time A or later, the peak of the voltage value gradually falls, and then at time B or later, it sticks to Low.

The time B is a timing at which time t1 elapses from the time A, and time C is a timing at which time t2 elapses from the time A (t2>t1).

The voltage value rising to High on the cyclic basis between the time A and the time B occurs because the rotation of the cleaning member 217 causes light received by the light receiving portion 216 to be temporarily blocked by the cleaning member 217.

It can be found from the above-mentioned voltage waveform in FIG. 8A that toner exists at a certain level in the first toner conveyance path 208 until the time A and little or no toner remains in the first toner conveyance path 208 at the time B or later.

The voltage waveform in FIG. 8B will be now described. In FIG. 8B, the voltage value at the times A, B, and C is High, and indicates almost no temporal change. Toner accumulated in the first toner conveyance path 208 is not reduced at the time B or later. That means that the optical path of the sensor 1516 is blocked by accumulated toner all the time. That indicates a high density of toner in the vicinity of the optical path of the sensor 1516, in which space is hardly generated even if the cleaning member 217 is rotated. That causes the light receiving portion 216 to receive little or no light, resulting in no falls in the voltage value. Such a voltage waveform implies toner clogging somewhere in the toner conveyance unit 900.

The voltage waveform in FIG. 8C will be now described. Toner is accumulated until the time A similarly to FIG. 8B. The same state continues at the time A and later for some time, space is generated by the rotation of the cleaning member 217 between the times A and B, the light receiving portion 216 starts to receive light from the light emitting portion 215 on the cyclic basis, and the peak of the voltage value gradually falls. At the time C and later, the voltage value sticks to Low. That means a greater quantity of toner supplied from the toner container 13 to the first toner conveyance path 208 than that supplied from the first toner conveyance path 208 to the second toner conveyance path 209 by the upstream conveyance screw 905, which means that toner is accumulated. With the toner supply from the pump 302 stopped and the upstream conveyance screw 905 driven at the time A and later, toner is gradually conveyed downstream due to no toner clogging occurrence, and little or no toner blocks the optical path of the sensor 1516 at the time C. In other words, under the excessive supply condition, the time period with the high voltage value is long until the time B similarly to the case under the abnormal condition (when toner clogging occurs), but the voltage value sticks at the time C unlike the case under the abnormal condition.

Subsequently, an abnormality detection flowchart of the toner conveyance unit 900 will be described with reference to FIGS. 7A and 7B. The abnormality detection procedure uses differences among the voltage waveforms illustrated in FIGS. 8A to 8C.

Figure 7A:
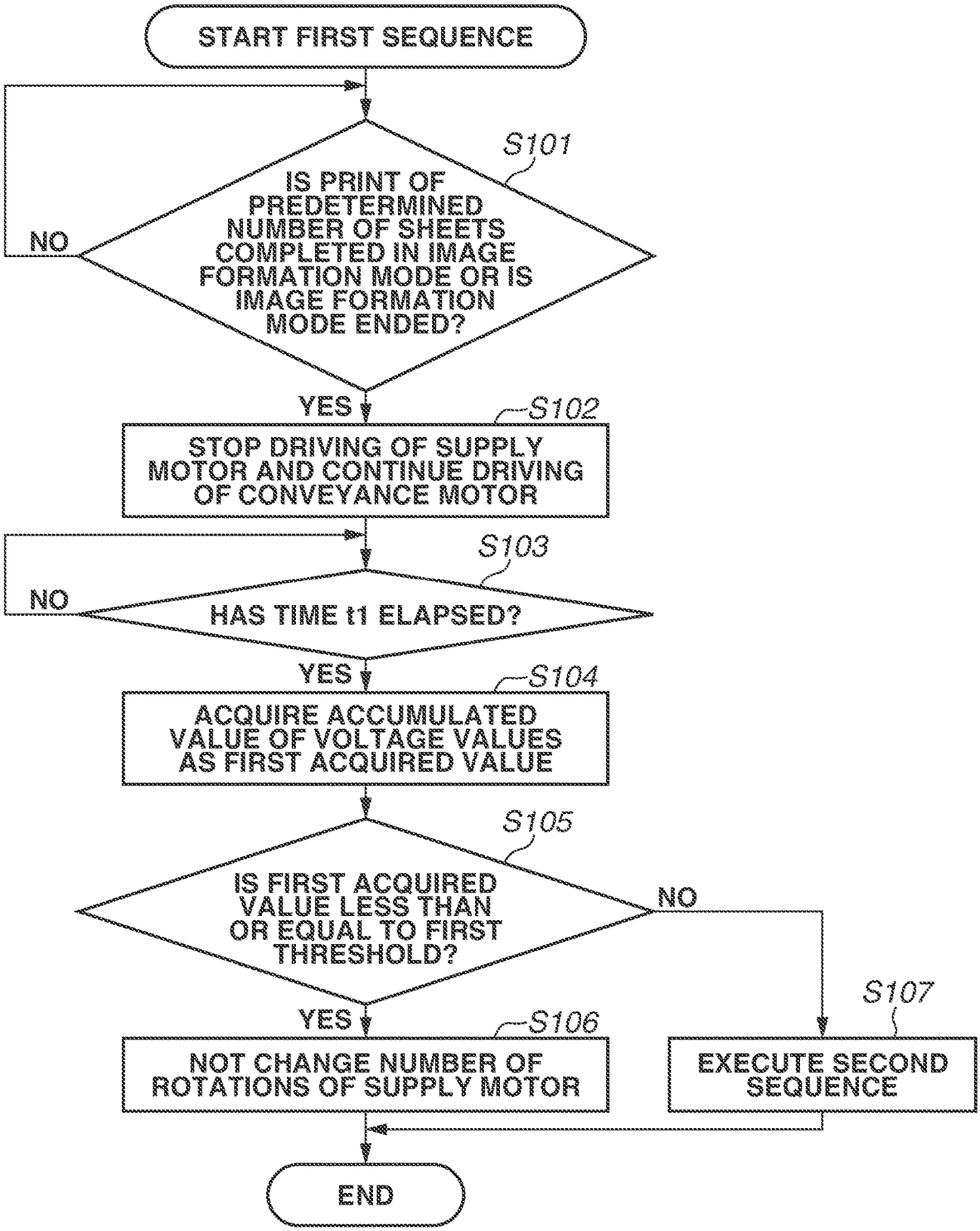
FIGS. 7A and 7B are abnormality determination flowcharts according to the first exemplary embodiment.
Figure 7B:
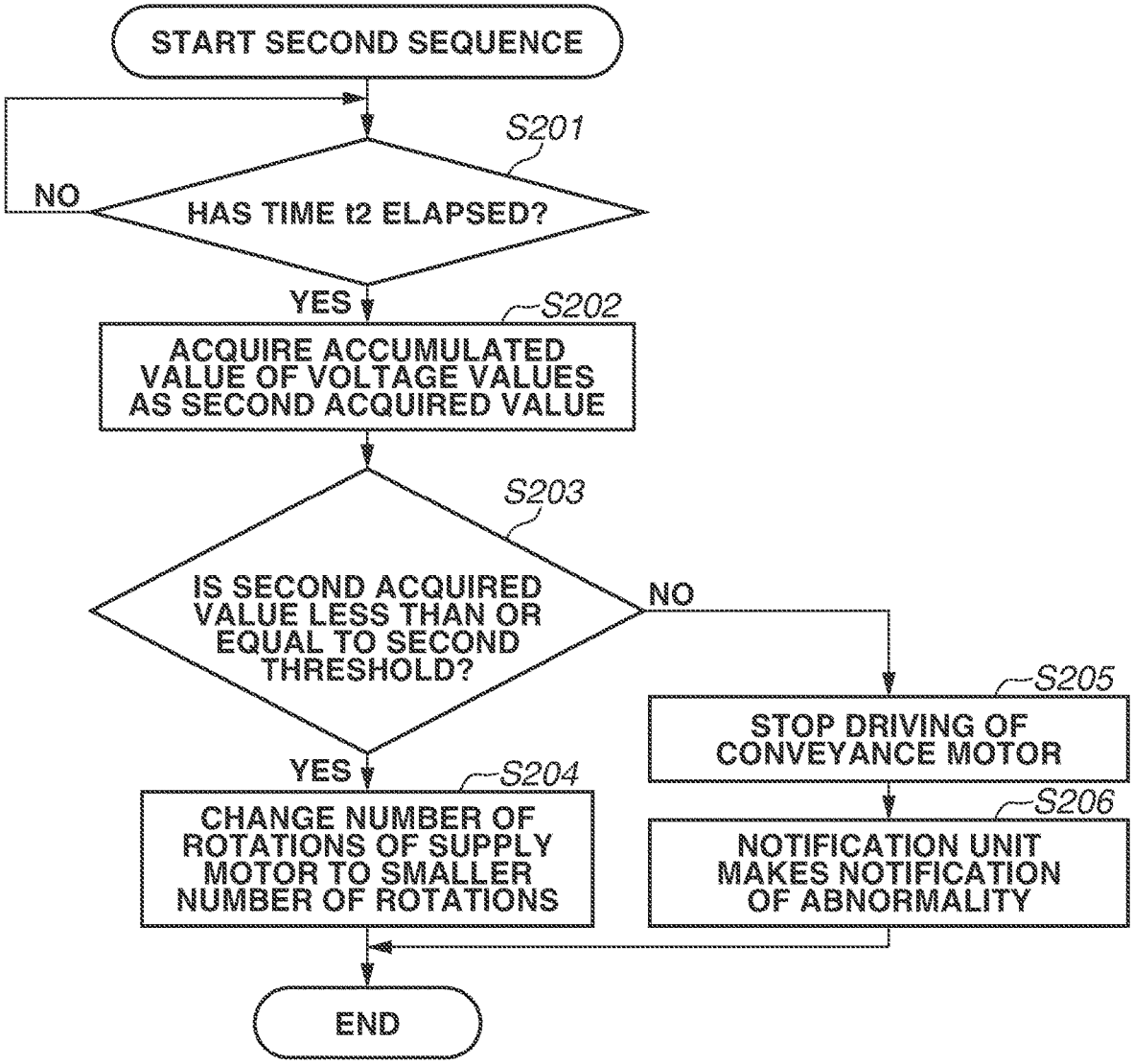

FIGS. 7A and 7B are flowcharts of the abnormality detection mode of detecting an abnormality of the toner conveyance unit 900 according to the first exemplary embodiment. FIG. 7A is a flowchart for a first sequence. FIG. 7B is a flowchart for a second sequence.

In FIG. 7A, in step S101, the control unit 27 determines whether the current timing is a timing in the middle of the image formation mode (print job) and at which the consecutive printing on a predetermined number of sheets is completed or the end timing of the image formation mode. If the current timing is a timing in the middle of the image formation mode and at which the consecutive print job with a predetermined number of sheets is completed or the end timing of the image formation mode (YES in step S101), the processing proceeds to step S102. In step S102, the control unit 27 stops the driving of the supply motor 404 and drives the conveyance motor 405. If the abnormality detection mode is operated in the middle of the image formation mode, the image formation is interrupted. In step S103, the control unit 27 determines whether time t1 (first predetermined time) elapses after stopping the driving of the supply motor 404. If the predetermined time t1 elapses (YES in step S103), the processing proceeds to step S104. In step S104, the acquisition unit 402 acquires a first accumulated value (first acquired value) obtained by accumulating voltage values output from the sensor 1516. In step S104, the acquisition unit 402 accumulates the voltage values for a predetermined time period (first predetermined time period). In step S105, the control unit 27 compares the first accumulated value with a first threshold. If a first condition that the first accumulated value exceeds the first threshold is not satisfied (if the first acquired value is less than or equal to the first threshold) (YES in step S105), the processing proceeds to step S106. In step S106, the control unit 27 does not change the number of rotations of the supply motor 404, and ends the processing. If the first condition is satisfied (if the first acquired value exceeds the first threshold) (NO in step S105), the processing proceeds to the second sequence in step S107.

In the second sequence illustrated in FIG. 7B, in step S201, the control unit 27 determines whether time t2 (>t1) elapses after stopping the driving of the supply motor 404. If the predetermined time t2 elapses (YES in step S201), the processing proceeds to step S202. In step S202, the acquisition unit 402 acquires a second accumulated value (second acquired value) obtained by accumulating voltage values output from the sensor 1516. In step S202, the acquisition unit 402 accumulates the voltage values for a predetermined time period (second predetermined time period). In step S203, the control unit 27 compares the second accumulated value with a second threshold. If a second condition that the second accumulated value exceeds the second threshold is not satisfied (if the second acquired value is less than or equal to the second threshold) (YES in step S203), the processing proceeds to step S204. In step S204, the control unit 27 sets the number of rotations of the supply motor 404 to a smaller number than the number of rotations in the image formation mode before execution of the abnormality determination sequence, and ends the processing. If the second condition is satisfied (if the second acquired value exceeds the second threshold) (NO in step S203), the processing proceeds to step S205. In step S205, the control unit 27 stops the conveyance motor 405. In step S206, the notification unit 403 makes notification of abnormality. The first threshold and the second threshold may be identical, or may be different from each other.

According to the present exemplary embodiment, the abnormality detection mode is divided into two: the first sequence and the second sequence. That contributes to short downtime by not to run the second sequence at the timing when no abnormality is found in the first sequence. In addition, the control unit 27 compares the first accumulated value obtained by accumulating voltage values from the sensor 1516 with the first threshold in step S105. That reduces the effect of variation in voltage values (noise) due to the rotation of the cleaning member 217. Another method may be employed. For example, in step S105, the control unit 27 may compare a first average value obtained by averaging the voltage values for a predetermined period with a third threshold. Similarly, in step S203, the control unit 27 may compare a second average value obtained by averaging the voltage values for a predetermined period with a fourth threshold.

The following method can be used with a configuration of independently driving the cleaning member 217 and the upstream conveyance screw 905. The control unit 27 may stop the driving of the cleaning member 217 at a detection timing with the sensor 1516, and compare a voltage value (first voltage value) itself at a certain timing at the time B or later with a fifth threshold. Similarly, in step S203, the control unit 27 may stop the driving of the cleaning member 217 at a detection timing with the sensor 1516, and compare a voltage value (second voltage value) itself at a certain timing at the time B or later with a sixth threshold.

Figure 9A:
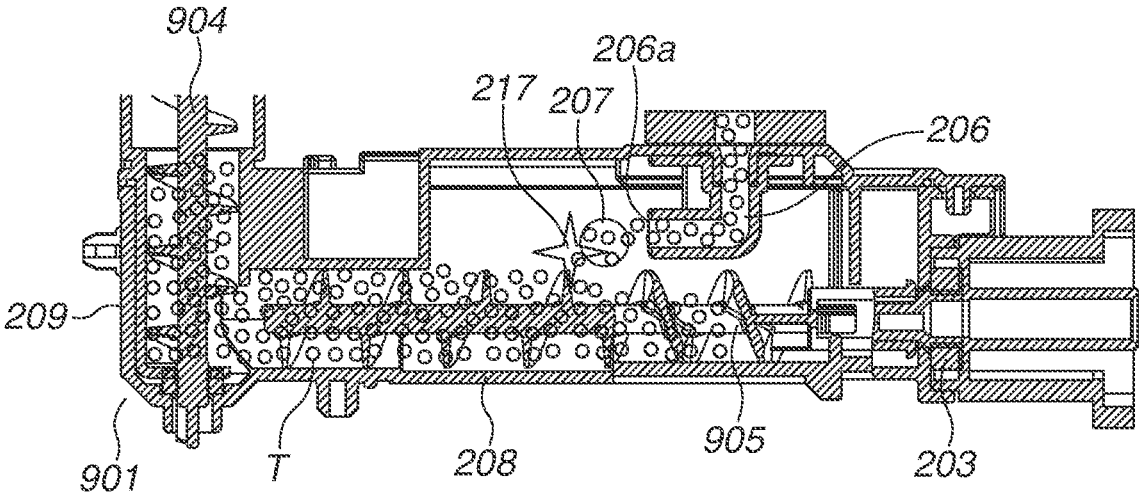
FIGS. 9A to 9B are sectional views each illustrating a toner conveyance unit according to a second exemplary embodiment.
Figure 9B:
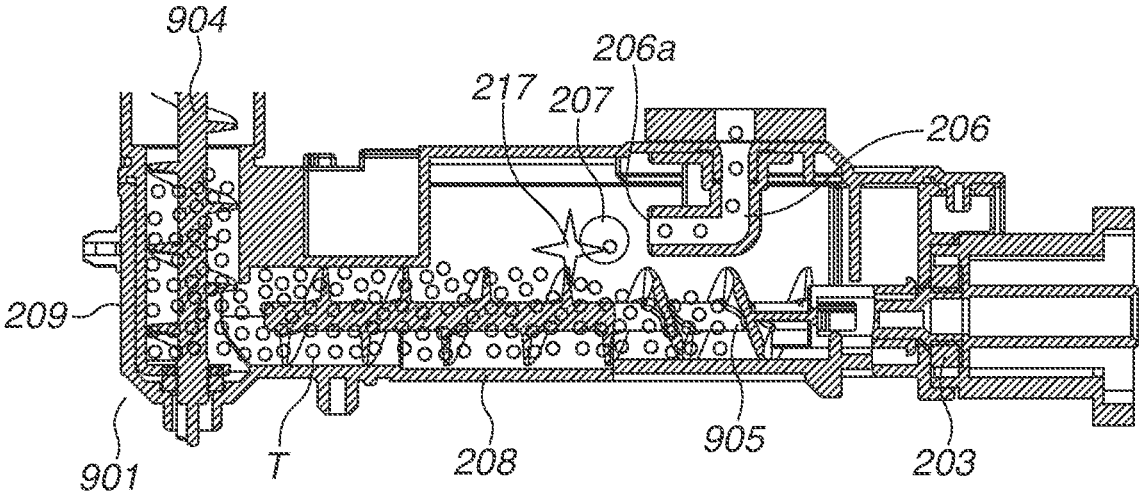

A second exemplary embodiment according to the present invention will be described. The toner conveyance device 14 according to the second exemplary embodiment will be described in detail with reference to FIGS. 9A and 9B. FIGS. 9A and 9B are sectional view each illustrating the toner conveyance device 14, the pump 302, and the toner conveyance driving device 15 according to the second exemplary embodiment as seen from a lateral side.

The sensor 1516 and the light transmitting portion 207 are arranged in the region through which toner discharged from the leading end port 206*a* of the toner receiving path 206 passes. That configuration allows detection of whether toner is supplied from the toner container 13 to the first toner conveyance path 208. In other words, that configuration allows detection of a remaining toner quantity in the toner container 13. Except for the arrangement of the sensor 1516 and the light transmitting portion 207, the other configurations and operations of the toner conveyance driving device 15 are similar to those of the first exemplary embodiment.

Detailed Description of Control Unit 270

Figure 10:
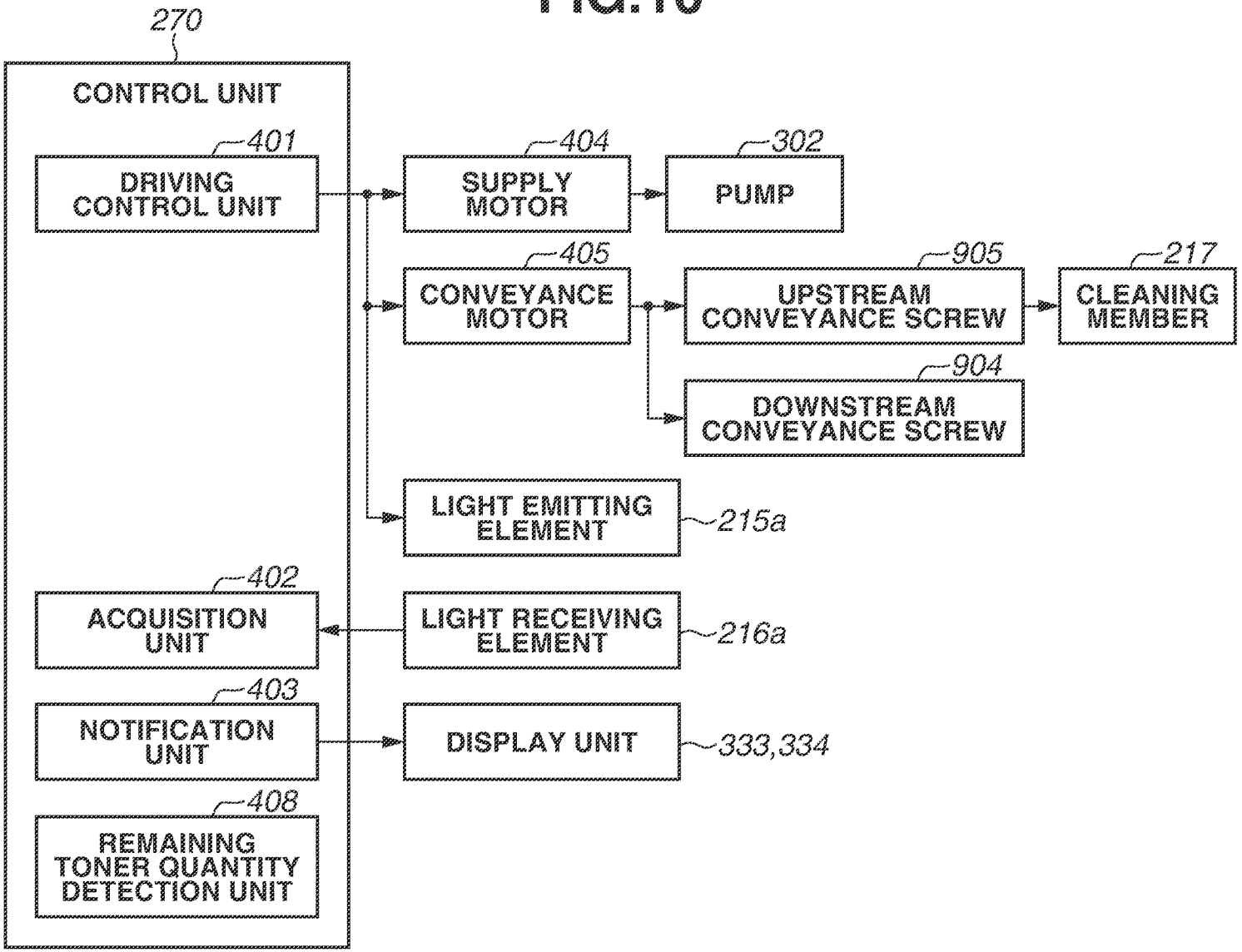
FIG. 10 is a control block diagram according to the second exemplary embodiment.

A control unit 270 according to the second exemplary embodiment will be described with reference to the block diagram of FIG. 10. The second exemplary embodiment is different from the first exemplary embodiment in inclusion of a remaining toner quantity detection unit 408. The remaining toner quantity detection unit 408 detects a remaining toner quantity in the toner container 13 based on an acquired value acquired by the acquisition unit 402.

Detection of Remaining Toner Quantity

A method of detecting the quantity of remaining toner in the toner container 13 will be now described with reference to FIGS. 9A and 9B.

FIG. 9A is a schematic diagram illustrating a state of toner that passes through the toner receiving path 206 and is discharged from the leading end port 206*a* with a large quantity of remaining toner in the toner container 13. FIG. 9B is a schematic diagram illustrating a state of toner that passes through the toner receiving path 206 and is discharged from the leading end port 206*a* with a small quantity of remaining toner in the toner container 13.

With a large quantity of remaining toner in the toner container 13 as illustrated in FIG. 9A, a large quantity of toner is discharged from the leading end port 206*a*, and blocks light emitted from the light emitting portion 215. As a result, the quantity of light received by the light receiving portion 216 is smaller, causing higher voltage values output from the sensor 1516. With a smaller quantity of remaining toner in the toner container 13 as illustrated in FIG. 9B, a small quantity of toner is discharged from the leading end port 206*a*, causing the quantity of light received by the light receiving portion 216 to become larger. That leads to lower voltage values output from the sensor 1516. The remaining toner quantity detection unit 408 uses differences between high and low voltage outputs from the sensor 1516 to detect quantities of remaining toner in the toner container 13.

While the supply motor 404 is being driven, the acquisition unit 402 acquires a third accumulated value (third acquired value) obtained by accumulating voltage values (acquired values) output from the sensor 1516 for a predetermined time period. If the third acquired value exceeds a seventh threshold, the remaining toner quantity detection unit 408 determines that there is sufficient toner in the toner container 13. If the third acquired value is below the seventh threshold, the remaining toner quantity detection unit 408 determines that there is a small quantity of toner in the toner container 13 or the toner runs out, and the notification unit 403 notifies the user of the small quantity of toner or the runout of toner.

Abnormality Detection Mode

Figure 11A:
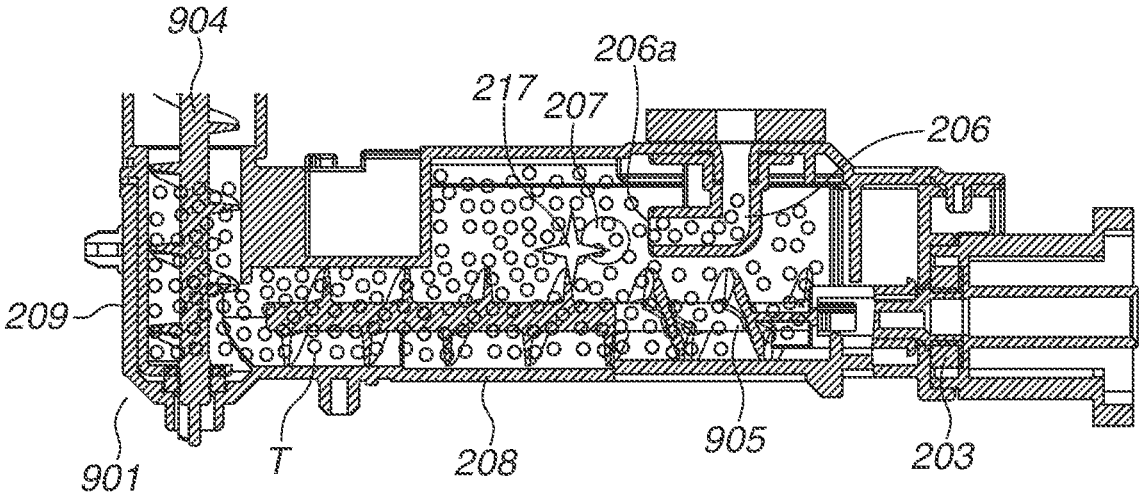
FIGS. 11A and 11B are sectional views each illustrating the toner conveyance unit according to the second exemplary embodiment.
Figure 11B:
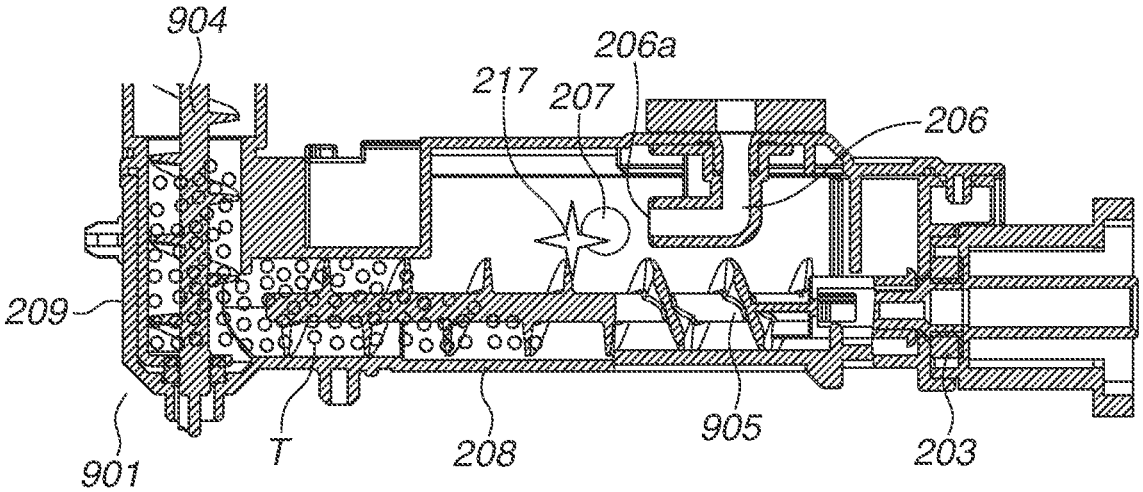

FIGS. 11A to 11B are sectional views illustrating a toner conveyance unit 901. FIG. 9A illustrates the toner conveyance unit 901 under the normal condition when there is sufficient toner in the toner container 13. FIG. 11A illustrates a state where the optical path of the sensor 1516 is blocked under the abnormal or excessive supply condition. FIG. 11B illustrates a state where the excessive supply is eliminated by driving of the upstream conveyance screw 905 with toner supply from the toner container 13 stopped, to convey toner downstream. That is, FIGS. 9A, 11A, and 11B correspond to FIGS. 6A, 6B, and 6C, respectively, in the first exemplary embodiment. The processing procedure of detecting an abnormality in the toner conveyance unit 901 in the second exemplary embodiment is identical to that in FIGS. 7A and 7B in the first exemplary embodiment, and the redundant description thereof will be omitted.

In the present exemplary embodiment, the sensor 1516 is used in detection of a remaining toner quantity of the toner container 13 and detection of an abnormality in the toner conveyance unit 901.

While the light transmitting portion 207 according to the present exemplary embodiment is disposed so that the light emitting portion 215 and the light receiving portion 216 face each other in the direction orthogonal to the longitudinal direction of the first toner conveyance path 208, the present invention is not limited to that configuration.

Figure 12:
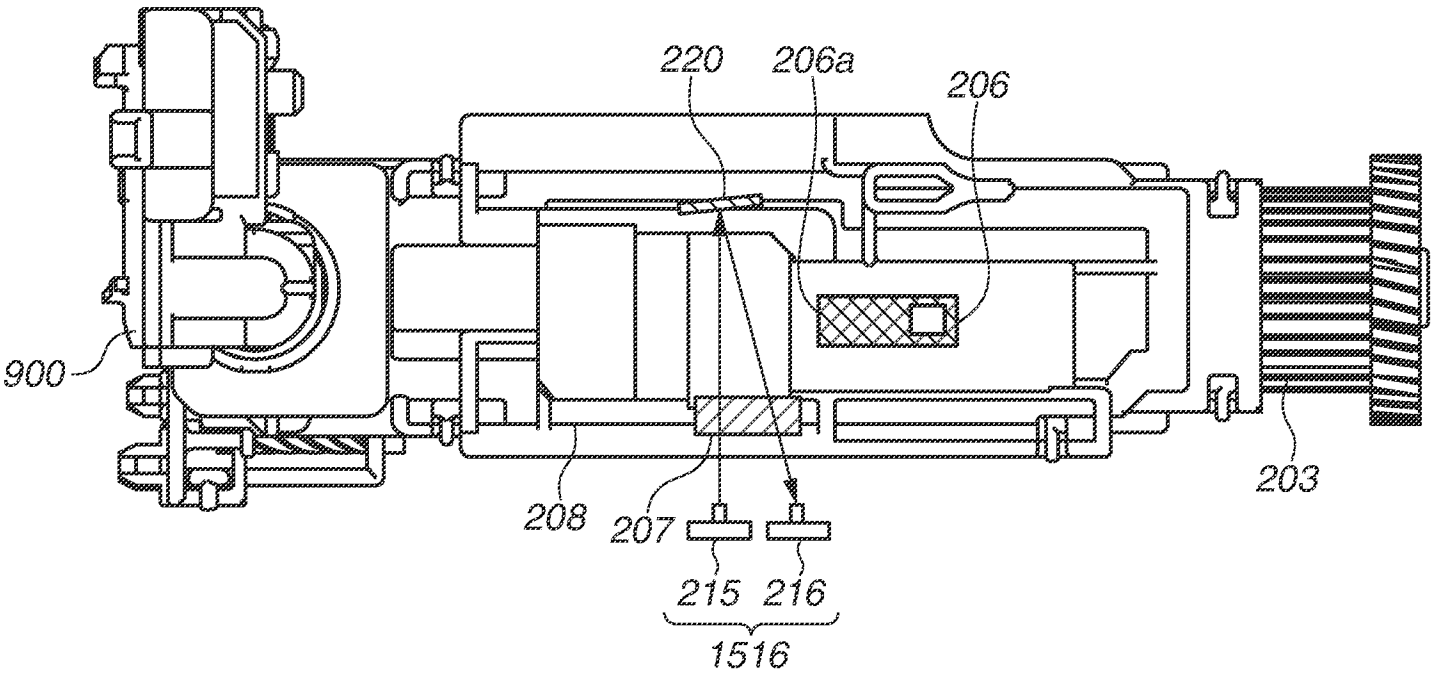
FIG. 12 illustrates a sensor according to a modification of the second exemplary embodiment.

FIG. 12 is a diagram illustrating the toner conveyance device 14 according to a modification of the second exemplary embodiment, the pump 302, and the toner conveyance driving device 15 as seen from the above. The light transmitting portion 207 is disposed on one wall in the direction orthogonal to the longitudinal direction of the first toner conveyance path 208, and a reflective member 220 is disposed on the other wall.

Furthermore, the light emitting portion 215 and the light receiving portion 216 are arranged side by side close to the light transmitting portion 207 in the longitudinal direction of the first toner conveyance path 208 outside the first toner conveyance path 208.

The reflective member 220 is disposed to reflect light emitted from the light emitting device 215*a* of the light emitting portion 215 toward the light receiving element 216*a* on the light receiving portion 216. That configuration allows light emitted from the light emitting device 215*a* on the light emitting portion 215 to pass through the light transmitting portion 207, and to be reflected on the reflective member 220 to pass through the light transmitting portion 207 again, and to be received by the light receiving element 216*a*. Even such a configuration allows detection of the quantity of remaining toner in the toner container 13 according to the second exemplary embodiment and detection of an abnormality in the toner conveyance unit 901 in the second exemplary embodiment. The configuration according to the present modification is also applicable to the configuration according to the first exemplary embodiment.

In the first and second exemplary embodiments, the output value from the sensor 1516 is a voltage value, but may be a current value. Furthermore, as the quantity of light received by the light receiving portion 216 becomes larger in the first and second exemplary embodiments, the output value (voltage value) from the sensor 1516 becomes smaller, but the output value may be reversed such that as the quantity of light received by the light receiving portion 216 becomes larger, the output value from the sensor 1516 becomes larger.

According to the first and second exemplary embodiments, the pump (air) is used as a unit for discharging toner in the toner container 13 from the toner container 13. The configuration however is not limited thereto. A configuration of discharging toner using a conveyance screw may be employed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-091609, filed May 31, 2021, which is hereby incorporated by reference herein in its entirety.

What is claimed is:

1. An image forming apparatus comprising:

a toner container configured to accommodate toner, wherein the toner container is provided with an outlet and includes a first conveyance unit where the first conveyance unit has a first screw for conveying the toner and is configured to discharge toner to an outside of the toner container through the outlet; and an apparatus main body on which the toner container is detachably mounted, wherein the apparatus main body includes:

a photosensitive drum, a development roller configured to supply toner to the photosensitive drum, a second conveyance unit including a second screw for conveying toner and configured to convey toner toward the development roller, a toner conveyance passage in which the second conveyance unit is provided and which is provided with a receiving inlet to receive toner discharged from the outlet of the toner container, a sensor including a light emitting portion configured to emit light toward an inside of the toner conveyance passage, and a light receiving portion configured to receive light emitted from the light emitting portion and passing through the inside of the toner conveyance passage, where the sensor is configured to output a signal based on a quantity of light received by the light receiving portion, and a central processing unit that is configured to control driving of the first conveyance unit and the second conveyance unit independently, is configured to execute an abnormality detection mode, and is configured to acquire an acquired value based on an output value from the sensor, wherein, in the abnormality detection mode, the central processing unit is configured to acquire a first acquired value after execution of the driving of the second conveyance unit for a first predetermined time in a state where the driving of the first conveyance unit is stopped, wherein, in a case where the first acquired value satisfies a first condition, the central processing unit is configured to further acquire a second acquired value after execution of the driving of the second conveyance unit for a second predetermined time in the state where the driving of the first conveyance unit is stopped, wherein the central processing unit further is configured to make notification of an abnormality in the toner conveyance passage, and, in a case where the second acquired value satisfies a second condition, the central processing unit is configured to make notification of the abnormality in the toner conveyance passage, and wherein the central processing unit further is configured to perform first control to control the first conveyance unit so that a quantity of toner supply per unit time from the toner container to the toner conveyance passage becomes a first quantity of supply, and, in the abnormality detection mode executed after the first control, in a case where the first acquired value satisfies the first condition and the second acquired value does not satisfy the second condition, the central processing unit is configured to execute second control to control the first conveyance unit so that the quantity of toner supply per unit time becomes a second quantity of supply that is smaller than the first quantity of supply.

2. The image forming apparatus according to claim 1, wherein the first conveyance unit is configured to be driven by driving force transmitted from a first motor, and the second conveyance unit is configured to be driven by driving force transmitted from a second motor, wherein the central processing unit is configured to control the first motor and the second motor independently, and wherein a number of rotations of the first motor per unit time under the second control is less than a number of rotations of the first motor per unit time under the first control.

3. The image forming apparatus according to claim 1, wherein the first acquired value is a first accumulated value obtained by accumulating a plurality of output values for the first predetermined time, and the second acquired value is a second accumulated value obtained by accumulating a plurality of output values for the second predetermined time, and wherein the first condition is that the first accumulated value exceeds a first threshold, and the second condition is that the second accumulated value exceeds a second threshold.

4. The image forming apparatus according to claim 1, wherein the toner conveyance passage includes a first light transmitting portion through which light emitted from the light emitting portion passes into the inside of the toner conveyance passage, and includes a second light transmitting portion through which light from the inside of the toner conveyance passage passes toward the light receiving portion, and wherein the apparatus main body further includes a cleaning member where the cleaning member includes a shaft portion that is rotatable and an elastic member attached to the shaft portion and is configured to clean the first light transmitting portion and the second light transmitting portion.

5. The image forming apparatus according to claim 4, wherein the cleaning member is configured to be driven while the second conveyance unit is driven, and the elastic member of the cleaning member is configured to rub the first light transmitting portion and the second light transmitting portion at least once during one rotation of the shaft portion.

6. The image forming apparatus according to claim 1, wherein the acquired value based on the output value from the sensor is the output value from the sensor.

7. The image forming apparatus according to claim 1, wherein the central processing unit is configured to execute an image formation mode to form an image on a recording material, and is configured to execute the abnormality detection mode immediately after a completion of the image formation mode.

8. The image forming apparatus according to claim 1, wherein the central processing unit is configured to execute an image formation mode to form an image on a recording material, and is configured to execute the abnormality detection mode by interrupting the image formation mode after every execution of image formation on a predetermined number of sheets.

9. An image forming apparatus comprising:

a toner container configured to accommodate toner, wherein the toner container is provided with an outlet and includes a first conveyance unit where the first conveyance unit has a first screw for conveying the toner and is configured to discharge toner to an outside of the toner container through the outlet; and an apparatus main body on which the toner container is detachably mounted, wherein the apparatus main body includes:

a photosensitive drum, a development roller configured to supply toner to the photosensitive drum, a second conveyance unit including a second screw for conveying toner and configured to convey toner toward the development roller, a toner conveyance passage in which the second conveyance unit is provided and which is provided with a receiving inlet to receive toner discharged from the outlet of the toner container, a sensor including a light emitting portion configured to emit light toward an inside of the toner conveyance passage, and a light receiving portion configured to receive light emitted from the light emitting portion and passing through the inside of the toner conveyance passage, where the sensor is configured to output a signal based on a quantity of light received by the light receiving portion, and a central processing unit that is configured to control driving of the first conveyance unit and the second conveyance unit independently, is configured to execute an abnormality detection mode, and is configured to acquire an acquired value based on an output value from the sensor, wherein, in the abnormality detection mode, the central processing unit is configured to acquire a first acquired value after execution of the driving of the second conveyance unit for a first predetermined time in a state where the driving of the first conveyance unit is stopped, wherein, in a case where the first acquired value satisfies a first condition, the central processing unit is configured to further acquire a second acquired value after execution of the driving of the second conveyance unit for a second predetermined time in the state where the driving of the first conveyance unit is stopped, wherein the central processing unit further is configured to make notification of an abnormality in the toner conveyance passage, and, in a case where the second acquired value satisfies a second condition, the central processing unit is configured to make notification of the abnormality in the toner conveyance passage, and wherein the central processing unit is configured to execute an image formation mode to form an image on a recording material, and is configured to execute the abnormality detection mode immediately after a completion of the image formation mode.

10. An image forming apparatus comprising:

a toner container configured to accommodate toner, wherein the toner container is provided with an outlet and includes a first conveyance unit where the first conveyance unit has a first screw for conveying the toner and is configured to discharge toner to an outside of the toner container through the outlet; and an apparatus main body on which the toner container is detachably mounted, wherein the apparatus main body includes:

a photosensitive drum, a development roller configured to supply toner to the photosensitive drum, a second conveyance unit including a second screw for conveying toner and configured to convey toner toward the development roller, a toner conveyance passage in which the second conveyance unit is provided and which is provided with a receiving inlet to receive toner discharged from the outlet of the toner container, a sensor including a light emitting portion configured to emit light toward an inside of the toner conveyance passage, and a light receiving portion configured to receive light emitted from the light emitting portion and passing through the inside of the toner conveyance passage, where the sensor is configured to output a signal based on a quantity of light received by the light receiving portion, and a central processing unit that is configured to control driving of the first conveyance unit and the second conveyance unit independently, is configured to execute an abnormality detection mode, and is configured to acquire an acquired value based on an output value from the sensor, wherein, in the abnormality detection mode, the central processing unit is configured to acquire a first acquired value after execution of the driving of the second conveyance unit for a first predetermined time in a state where the driving of the first conveyance unit is stopped, wherein, in a case where the first acquired value satisfies a first condition, the central processing unit is configured to further acquire a second acquired value after execution of the driving of the second conveyance unit for a second predetermined time in the state where the driving of the first conveyance unit is stopped, wherein the central processing unit further is configured to make notification of an abnormality in the toner conveyance passage, and, in a case where the second acquired value satisfies a second condition, the central processing unit is configured to make notification of the abnormality in the toner conveyance passage, and wherein the central processing unit is configured to execute an image formation mode to form an image on a recording material, and is configured to execute the abnormality detection mode by interrupting the image formation mode after every execution of image formation on a predetermined number of sheets.

* * * * *